US006283825B1

(12) United States Patent
Ulloa

(10) Patent No.: US 6,283,825 B1
(45) Date of Patent: Sep. 4, 2001

(54) AUTOMATIC TRIMMER MACHINE

(75) Inventor: Jose Ulloa, Roanoke, VA (US)

(73) Assignee: Johnson & Johnson Vision Products, Inc., Jacksonville, FL (US)

( * ) Notice: Subject to any disclaimer, the term of this patent is extended or adjusted under 35 U.S.C. 154(b) by 0 days.

(21) Appl. No.: 09/468,974

(22) Filed: Dec. 21, 1999

(51) Int. Cl.[7] ..... B24B 49/00

(52) U.S. Cl. ..... 451/5; 451/6; 451/11; 451/43; 451/256

(58) Field of Search ..... 451/5, 6, 8, 11, 451/42, 43, 44, 54, 255, 256, 258

(56) References Cited

U.S. PATENT DOCUMENTS

| | | | |
|---|---|---|---|
| Re. 35,898 | 9/1998 | Shibata et al. | 451/5 |
| 5,148,637 | 9/1992 | Byron | 51/165.71 |
| 5,210,695 | 5/1993 | Wood | 364/474.06 |
| 5,408,792 | 4/1995 | Gottschald | 451/65 |
| 5,454,194 | 10/1995 | Gottschald | 451/11 |
| 5,498,200 * | 3/1996 | Werner | 451/42 |
| 5,588,899 | 12/1996 | Gottschald | 451/5 |
| 5,727,987 | 3/1998 | Gottschlad | 451/5 |

* cited by examiner

*Primary Examiner*—Eileen P. Morgan

(57) ABSTRACT

An automatic trimmer machine for finding the geometrical center of an optic having a non-round periphery, trimming the edge of the optic to a prescribed diameter for each optic, cleaning and drying the optic, and verifying the diameter of the optic. The machine improves efficiency and reduces operator handling of the lens. Further, the work area is maintained substantially debris free.

18 Claims, 7 Drawing Sheets

AUTOMATIC TRIMMER MACHINE

FIELD OF THE INVENTION

The present invention relates to an automatic trimmer for trimming excess resin from the periphery of an optic.

BACKGROUND OF THE INVENTION

During casting or molding of an optic, excess resin or flash may result in irregular edges about the periphery of the optic. Machines are used to trim the flash from the periphery of an optic, but current trimming machines require the optic to be mounted on a block for positioning and holding. The use of a block is disadvantageous in that it must be removed after the trimming process is complete. In addition, the optic is secured to the block by an adhesive that must be cleaned off once the trimming operation is complete. These additional steps are complex and thus, relatively expensive to automate.

Conventional trimming machines are disadvantageous in several other respects. In particular, current machines require an operator to load and download the optic at each station. Trimmer machines typically require traced data to cut the optic to different diameters. Furthermore, the optic must be cleaned manually. For these reasons conventional trimming machines are inefficient and expensive in that they require individuals to perform manual operations.

In addition, during the trimming operation, it is important to maintain the work area substantially free from particles and debris. To ensure a substantially debris free work area, the trimming operation typically is performed in a separate area from the optic production area.

Because of the foregoing disadvantages associated with conventional trimming machines, the optimum cycle time is approximately at least 30 seconds per optic. Thus, additional machines are typically used in order to increase the production rate.

It is therefore desirable to develop an automatic trimming machine that solves one or more of the aforementioned problems.

DETAILED DESCRIPTION OF THE INVENTION

Figure 1:
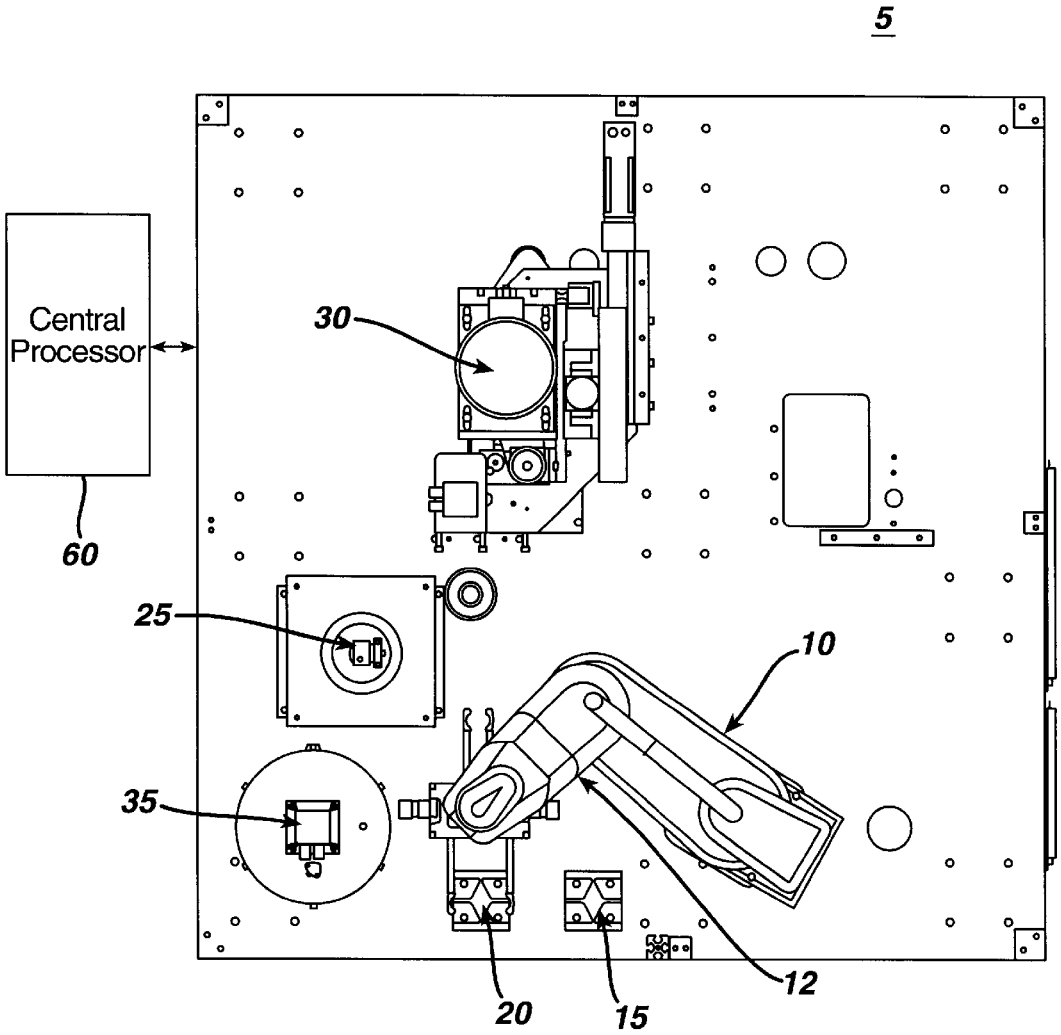
FIG. 1 is a top view of an exemplary automatic trimming machine in accordance with the present invention.

The present invention is directed to an automatic trimmer machine for finding the geometrical center of an optic having an irregular, non-symmetric, or non-round periphery, trimming excess resin from the edge of the optic to a prescribed diameter, cleaning and drying the optic, and verifying the diameter of the optic. For purposes of the invention, by "optic" is meant a spectacle lens or a preform. By "preform" or "optical preform" is meant a shaped, optically transparent article capable of refracting light and suitable for use in producing a spectacle lens.

The machine of the invention includes a transfer means for automatically loading and downloading the optic at stations and between stations, without having to adhere the optic to a block. Thus, the machine improves efficiency and reduces operator handling of the optic. The work area is maintained substantially debris free by isolating the grinding wheel and platform at a grinding station in a debris containment enclosure having cleaning means, such as spray nozzles directed towards the inner wall of the enclosure. Fluid, air, and the like, or a combination thereof sprayed from the nozzles attracts the ground particles and the particles are expelled from the enclosure without wetting the grinding wheel or the optic.

In addition, the invention relates to a method for manufacturing an optic using the apparatus described above. Specifically, an optic is automatically loaded on to and downloaded off of a platform of at least one of a plurality of processing stations, and transferred between each processing station in response to control signals generated by a controller. The plural processing stations include: a.) an infeed station for receiving the optic; b.) an imaging station for determining a center of the optic; c.) a trimming station for grinding the edge of the optic to a prescribed diameter or shape; d.) a cleaning and drying station for cleaning and drying the optic; and e.) an outfeed station for receiving the processed optic.

The invention is also directed to a method of manufacturing an optic that is automatically downloaded off of a platform at an infeed station using a transfer means and moved from the infeed station to an imaging station. At the imaging station, a center of the optic is detected while holding the optic in the transfer means. Thereafter, the transfer means moves the optic from the imaging station to a grinding station and automatically loads the optic onto a platform at the grinding station. Excess resin from the edge of the optic is trimmed using a grinding wheel based on a recipe selected from a plurality of prescribed recipes for different diameters or shapes stored in a memory device. The transfer means then automatically downloads the optic from the platform at the grinding station and moves the optic to the cleaning and drying station, where it is loaded on to a platform. At the cleaning and drying station, both surfaces of the optic are sprayed with a cleaning fluid, air, and the like, or a combination thereof and then the optic is rotated relative to a central axis to remove the fluid, if any, from the surfaces of the optic. Once the optic is cleaned and dried, the transfer means automatically downloads the optic from the platform at the cleaning and drying station and moves the optic to the outfeed station.

Figure 2:
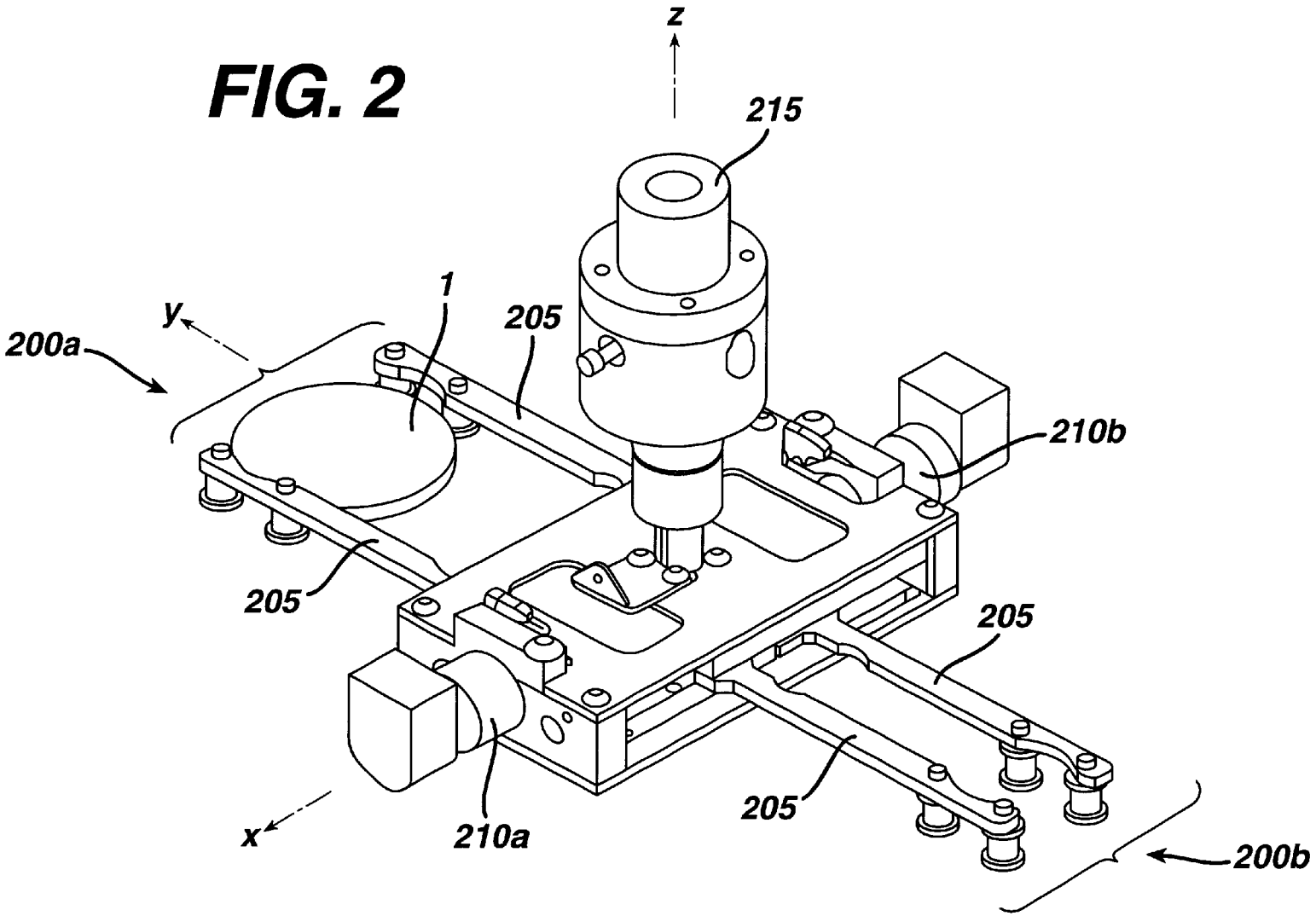
FIG. 2 is a perspective view of an exemplary duo-sided transfer means of the machine in FIG. 1.

FIG. 1 is top view of an automatic trimming machine 5 in accordance with the present invention that locates the geometrical center of an optic having non-uniform or non-round edges, trims the flash resin from the outer periphery of the lens to a selected diameter, cleans and drys the optic, and verifies the diameter of the optic. Automatic trimming machine 5 includes a transfer means 10, such as a mechanical arm or robot having a pivot arm 12. In a preferred embodiment, to increase efficiency, the transfer means 10 is preferably duo-sided as shown in FIG. 2, or more preferably multi-sided. As shown in FIG. 2, two grippers 200*a*, 200*b* capable of grasping two optics 1 are present. It is, however, within the intended scope of the invention to use a single sided transfer means 10 with only one gripper or a multi-sided transfer means with more than two grippers. The grippers are connected to the pivot arm 12 by a mount 215 and are displaceable along the z axis. Each gripper 200*a*, 200*b* has two fingers 205 that are displaceable with respect to one another in a horizontal plane between an open position and a closed position by motors 210*a*, 210*b*, respectively. By way of example, FIG. 2 shows one gripper in an open position holding a lens 1 about its periphery, while the other gripper is in a closed position. Transfer means 10 is used to load and download an optic at a particular processing station and to transport or move an optic between operating stations including an infeed station 15, an imaging station 25, a grinding station 30, a cleaning and drying station 35, and an outfeed station 20. The transfer means 10 of the machine in accordance with the present invention thereby eliminates the need to adhere the optic to a block for positioning and holding purposes.

Figure 3:
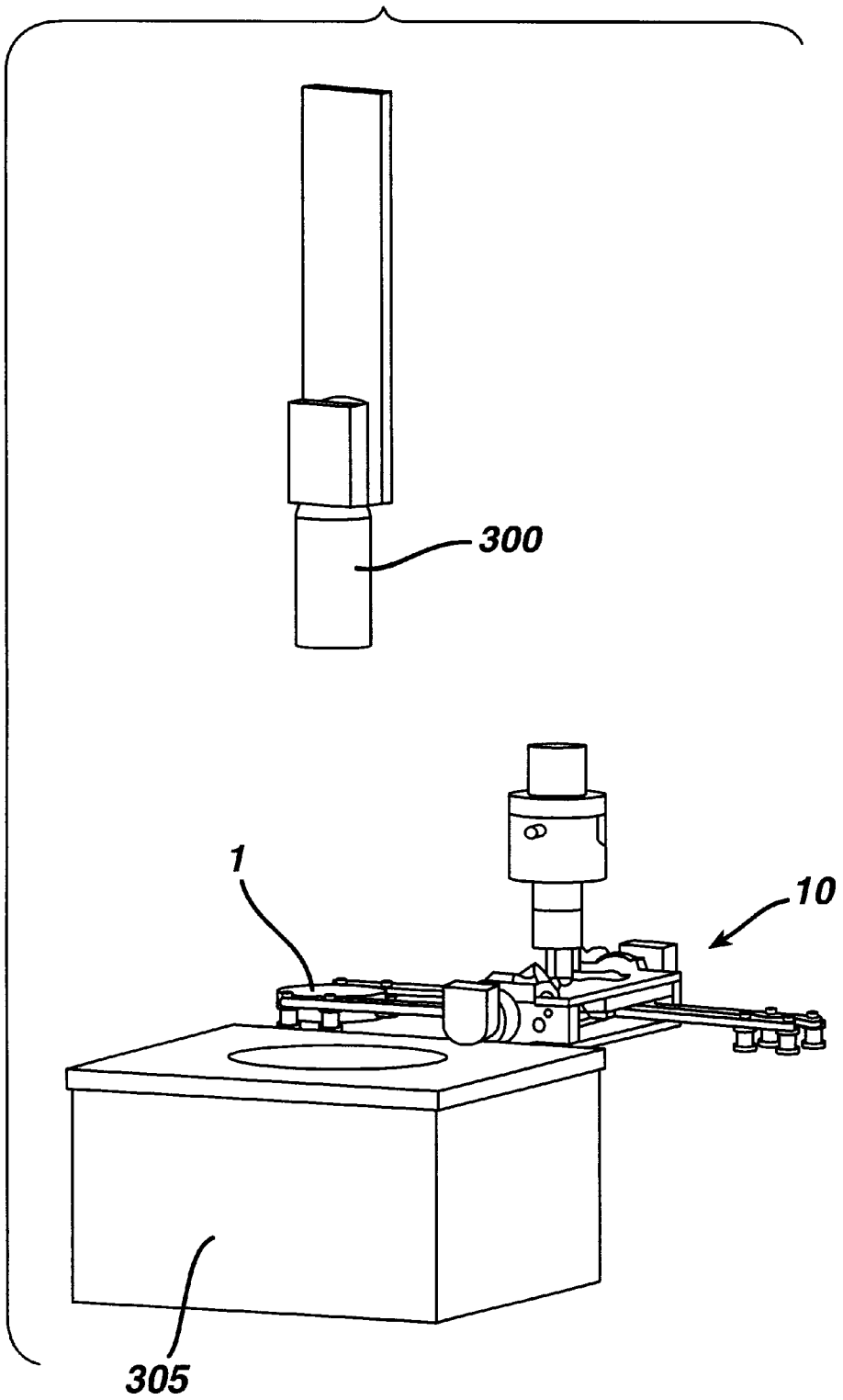
FIG. 3 is a perspective view of an exemplary imaging station of the machine in FIG. 1.

In operation, initially an optic is manually placed on a platform at the infeed station 15. Alternatively, the optic may be automatically placed on the platform using a separate robot or transfer means. Sensors (not shown) in the platform generate a signal to a remote central processor 60 indicating that the lens has been placed at the infeed station 15. The operator or user selects a recipe from a plurality of prescribed recipes stored in a memory of the remote central processor 60. Alternatively, the memory device may be part of a local, central processor in the machine itself. A signal is generated by the central processor 60 in response to selection of a recipe indicating that the optic 1 is ready to be processed. Transfer means 10 picks up the optic from the platform of the infeed station 15 and moves the optic to the imaging station 25 between a lighting source 305 and a charge coupled device 300 that takes an image of the optic 1 to determine its center, as shown in FIG. 3

In a preferred embodiment, the center of the optic is determined using conventional dark field light to make the edge of the optic shine. Specifically, after casting, the outer edge of the optic is irregular in shape due to the excess or flash resin. However, when the optic is illuminated by the light a substantially round inner edge is visible. The substantially round inner edge is used as a reference to determine the center of the optic. Alternatively, mechanical probes may be positioned around the periphery of the optic to determine the center using known techniques. Once the center of the optic has been located, central processor 60 computes the distance necessary to move the optic so that it is concentric with the platform.

Figure 4:
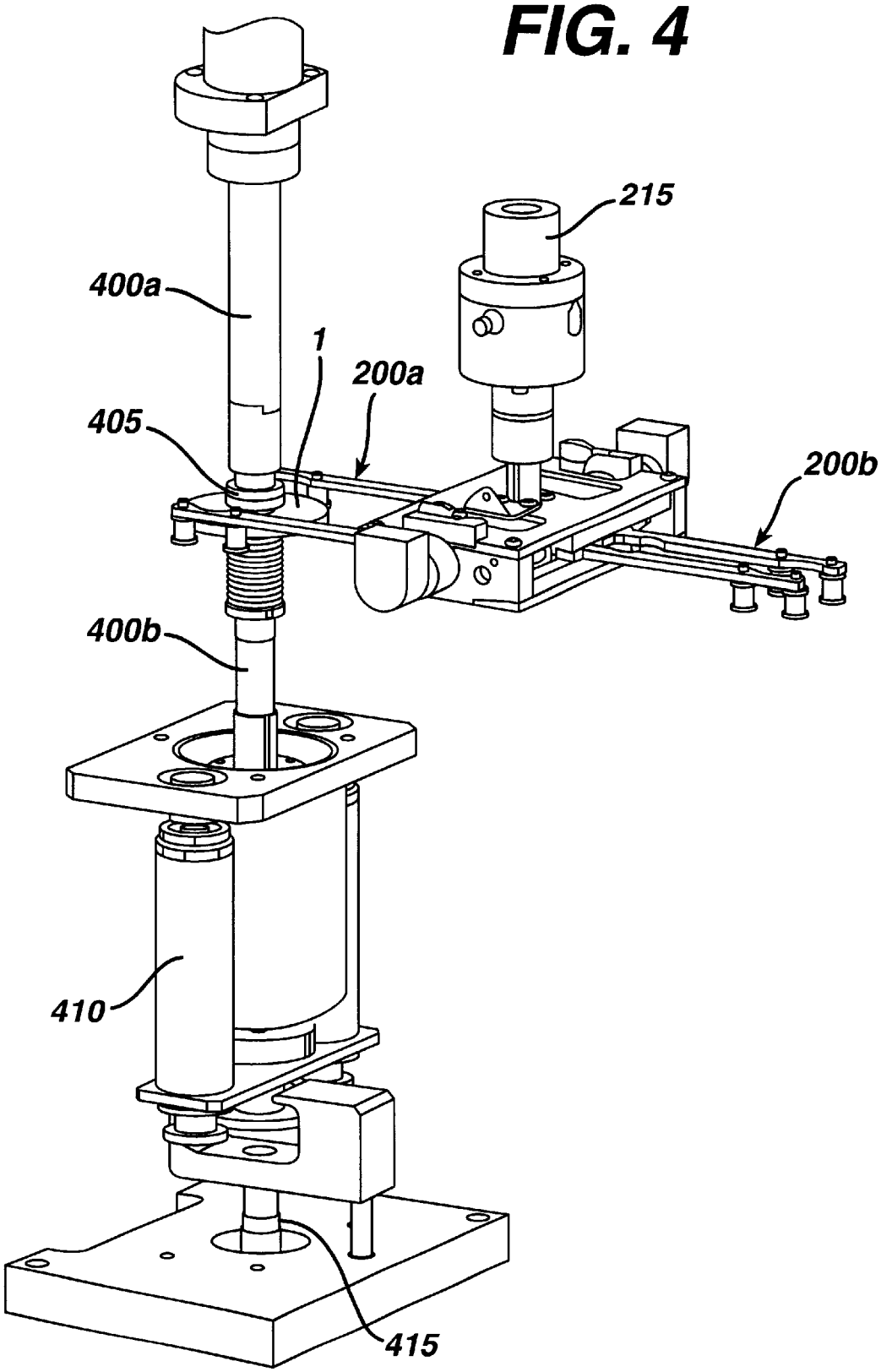
FIG. 4 is a perspective view of an exemplary platform at the grinding station holding a lens.

Next, the transfer means 10 moves the optic from the imaging station 25 to the grinding station 30, as shown in FIG. 4. At the grinding station 30 the optic 1 to be cleaned is positioned between pads 405 and held in place by a pair of vertically displaced support members 400*a*, 400*b*. Specifically, during loading of the optic on to the platform the lower support member 400*b* is lowered out of the way via an air cylinder 415 and the optic is positioned so as to be in contact with the upper support member 400*a*, while being held by the gripper 200*a*. After the optic has been positioned concentric with the upper support member 400*a*, the lower support member 400*b* is raised by the air cylinder 415 until it pushes simultaneously against the optic 1 and gripper 200*a* causing the fingers to extend radially outward and release the optic, which is held securely between the upper and lower support members 400*a*, 400*b*. A spring 410 maintains the lower support member 400*b* in contact with the optic 1.

As mentioned above, the transfer means 10 is preferably duo-sided so that it is capable of simultaneously holding or grasping two optics. If a first optic that has been ground is currently being processed in the grinding station 30, while grasping with gripper 200*a* a second optic to be ground, gripper 200*b* picks-up and downloads the first optic from the platform at the grinding station 30 and then gripper 200*a* loads the second optic on to the platform of the grinding station 30.

Figure 5:
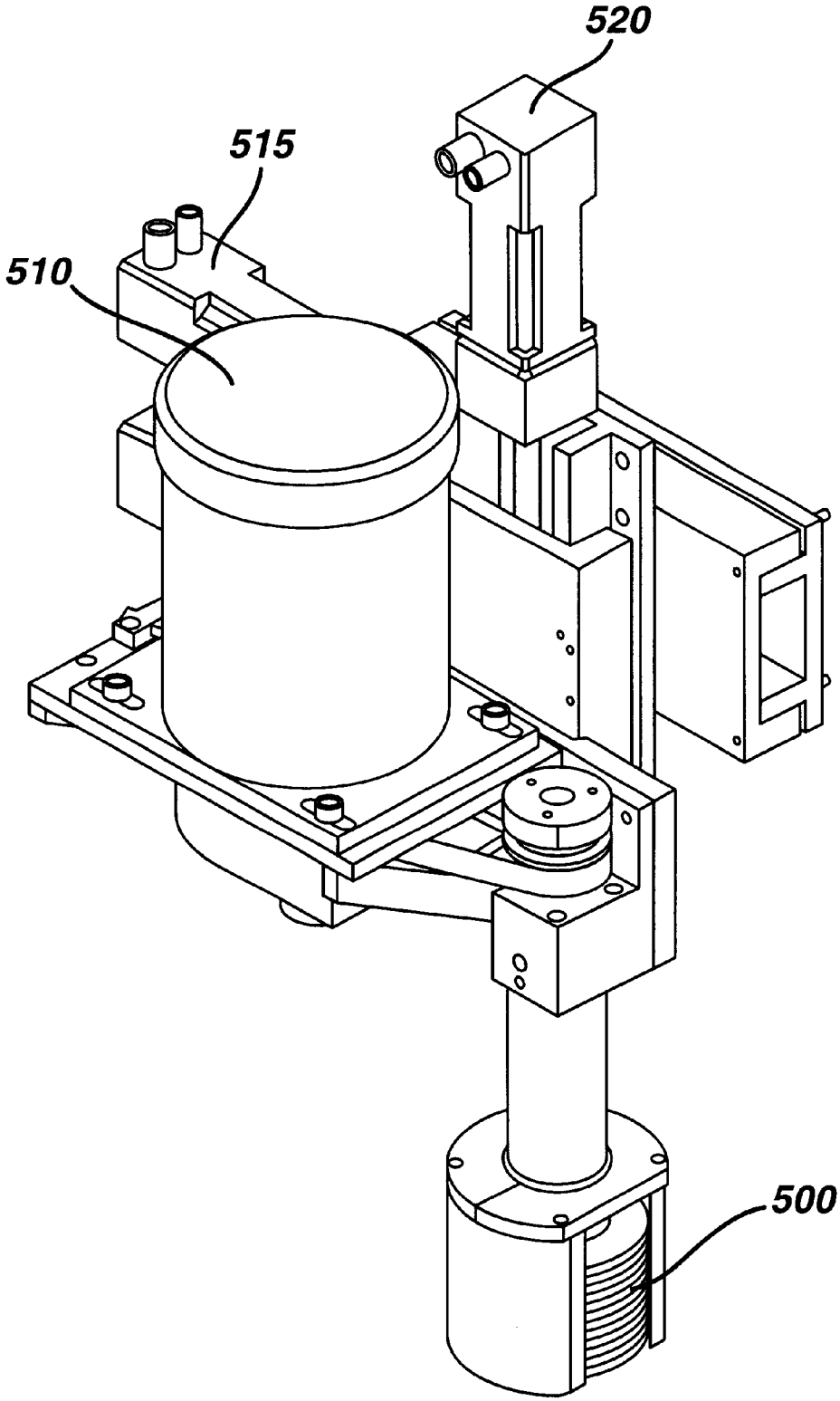
FIG. 5 is a perspective view of an exemplary grinding station of the machine in FIG. 1.

At the grinding station 30 the excess resin is trimmed from the periphery of the optic using a grinding wheel. In FIG. 5, grinding wheel 500 is moved proximate the periphery of the optic using horizontal and vertical motors 515, 520, respectively, and once properly positioned, the wheel is driven by a motor 510.

Figure 6:
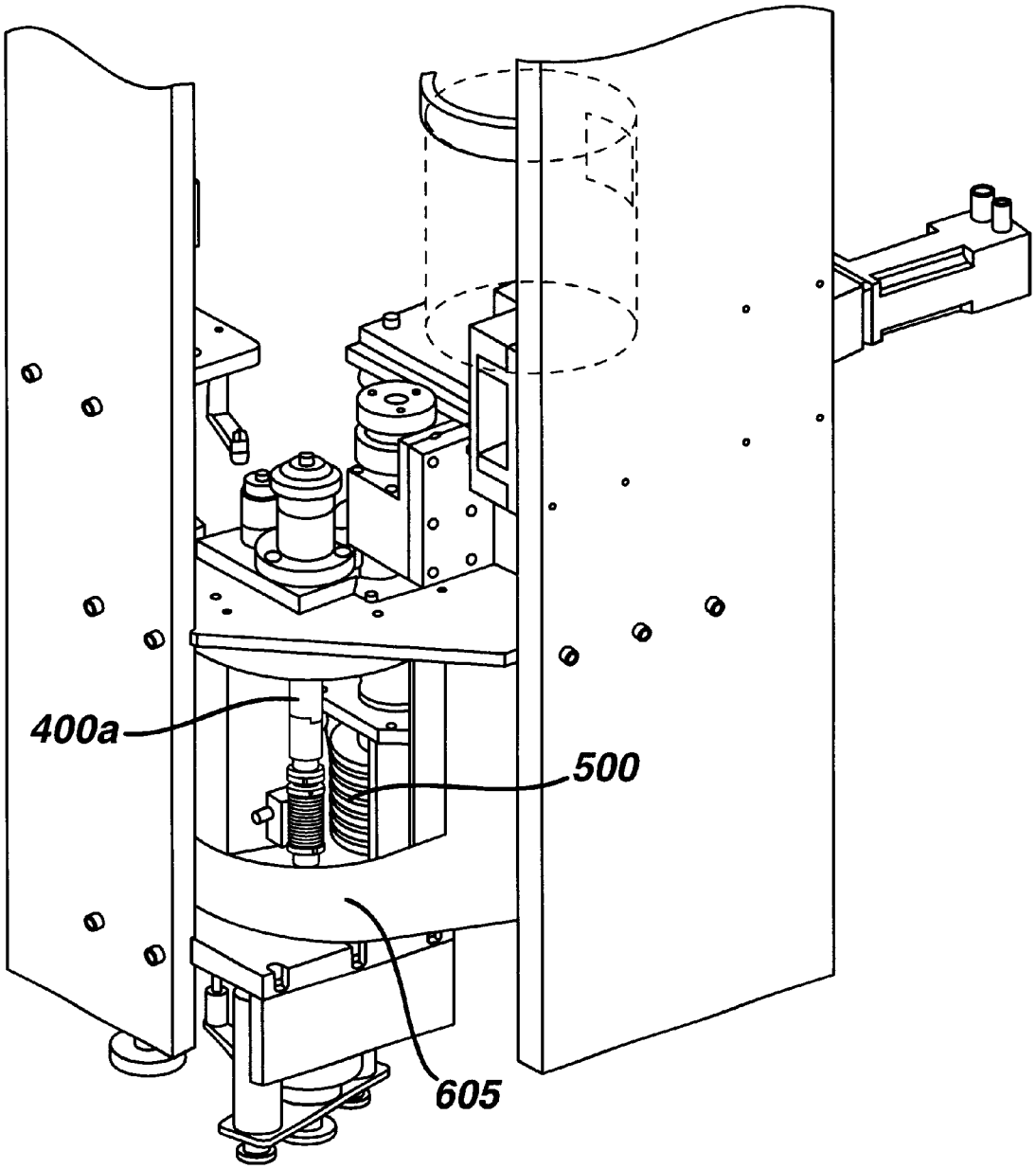
FIG. 6 is a cut-away perspective view of an exemplary debris containment enclosure surrounding the grinding station of the machine in FIG. 1.

The particles and debris, for example, of polycarbonate material, produced as a result of grinding the excess resin from the periphery of the optic reduce overall efficiency of the machine and may ultimately result in mechanical failure. It is therefore desirable to maintain a substantially debris free work area by wetting the ground particles without wetting the optic and grinding wheel 500. This is accomplished by isolating the grinding wheel 500, platform 400*a*, 400*b* and optic 1 in a debris containment enclosure 605, as shown in the cut-away perspective view in FIG. 6. While grinding the excess resin from the periphery of the optic, an array of nozzles disposed along the periphery of the enclosure sprays a fluid, for example, deionized water, air, and the like, or a combination thereof against the inner wall of the enclosure. The ground particles or debris are attracted to the sprayed water and flushed out of the debris containment enclosure 605 via a series of channels in the floor of the enclosure. This debris containment system is advantageous in that it keeps the grinding wheel 500 substantially free from ground particles, yet prevents the optic and grinding wheel 500 from getting wet.

After the excess resin has been trimmed from the periphery of the optic, the transfer means 10 downloads the optic from between the vertical support members 400*a*, 400*b* of the grinding station 30 and moves the optic to the cleaning and drying station 35. To remove the optic from between the vertical support members 400*a*, 400*b* of the grinding station 30, the fingers of the gripper 200*a* are placed around the periphery of the optic and then the lower support member 400*b* is lowered thereby releasing the optic.

Figure 7:
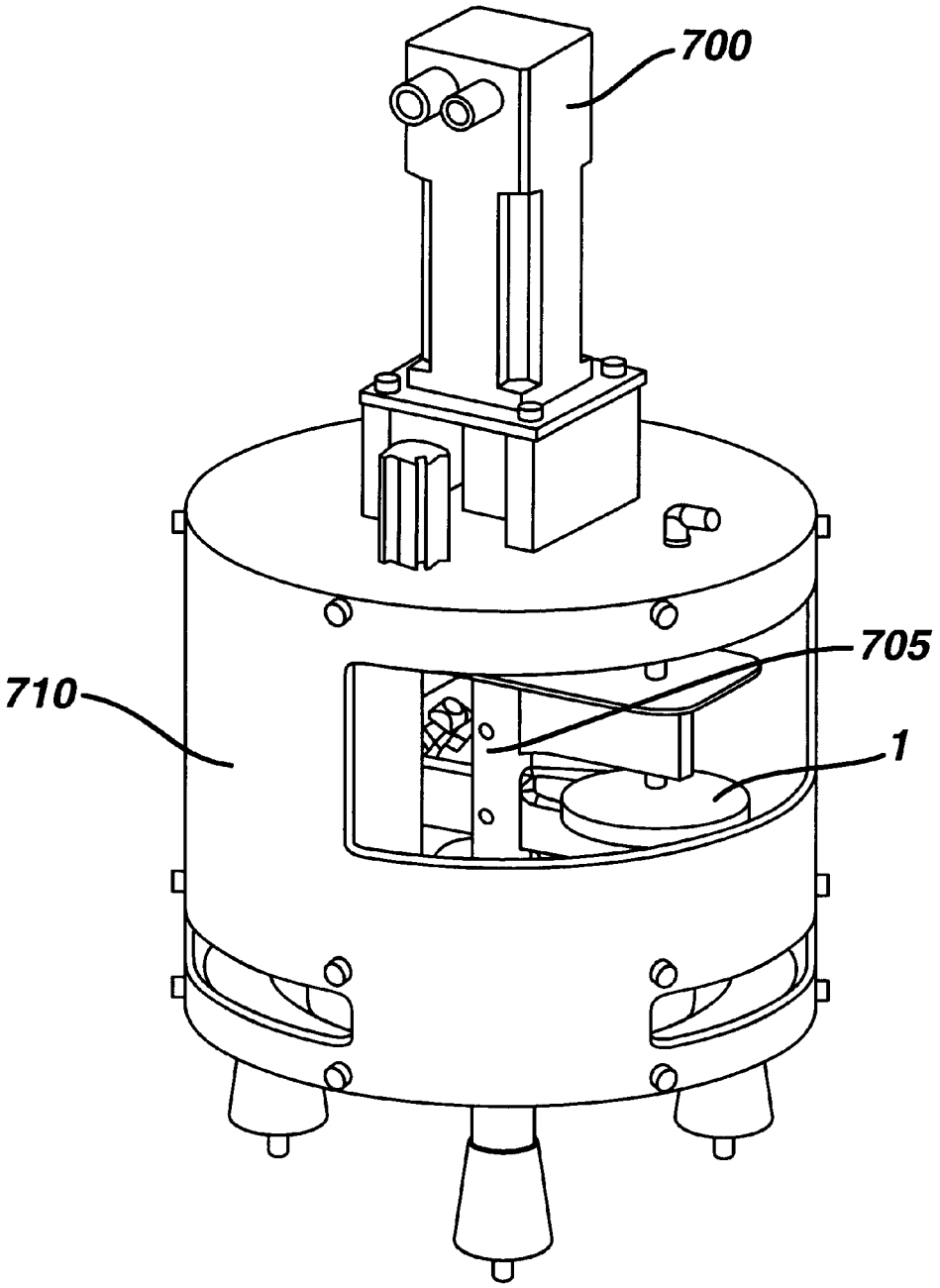
FIG. 7 is a perspective view of an exemplary cleaning and drying station of the machine in FIG. 1.

At the cleaning and drying station 35, the optic is held by a platform of similar construction to that provided at the grinding station 30. If a first optic that has been cleaned and dried is loaded on the work station of the cleaning and drying station 35 then the duo-sided gripper, while grasping a second optic to be cleaned and dried, downloads the first optic from the cleaning and drying station 35 and then loads the second optic to be cleaned. Once the optic has been positioned on the platform at the cleaning and drying station 35, both surfaces of the optic are sprayed with a cleaning fluid, such as deionized water. As shown in FIG. 7, vertical support members 400*a*, 400*b* are mounted eccentrically on a shaft connected to a center axis 705 that is driven by a servomotor 700. The centrifugal force generated by rotation of the optic causes the cleaning fluid to slide off the surfaces of the lens, hit the side of the water and air containment enclosure 710, and fall into a channel for receiving the run-off cleaning fluid.

The transfer means 10 moves the optic from the cleaning and drying station 35 to the outfeed station 20. While moving the optic to the outfeed station 20, the gripper is simultaneously verifying the diameter of the optic and transmitting the detected information to the central processor 60 to check that it conforms with the selected recipe. After the optic has been placed on the platform at the outfeed station 20 and the transfer means 10 has been moved out of the way, the machine transmits information to the central processor 60 signaling that processing of the optic is completed. When the optic is picked up from the platform at the outfeed station 20, the signal is reset.

The machine of the invention provides an automatic trimming machine that eliminates the need to mount the optic on a block. Additionally, an automatic trimming machine that has a cycle time of approximately 10 seconds is provided. The automatic trimming machine that is completely automatic in that it does not require manual loading or downloading of the optic. The trimming machine cuts the optic to different diameters and shapes without the need for traced data. Finally, the automatic trimming machine of the invention cleans and dries the optic automatically while maintaining a work area substantially free from debris.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

What is claimed is:

1. A machine for processing of an optic, comprising:

controller; and transfer means for automatically loading said optic on to and downloading said optic off of a platform of at least one of a plurality of processing stations, and transferring said optic between each processing station in response to control signals generated by said controller, said plural processing stations including:

an infeed station for receiving said optic, an imaging station for determining a center of said optic said imaging station comprising a charge coupled device and an illumination source for illuminating said optic so as to detect a substantially circular inner edge by which the center of said optic is determined, a trimming station for grinding the edge of said optic to a prescribed diameter said trimming station comprising a platform and a grinding wheel for trimming the edge of said optic based on a prescribed diameter and a debris containment enclosure disposed about said platform and grinding wheel, said debris containment enclosure having an array of nozzles oriented so that one of a fluid, air, or a combination thereof sprayed from each nozzle hits the inner surface of said enclosure and run-off therefrom is directed into a channel, a cleaning and drying station for cleaning and drying said optic, and an outfeed station for receiving the processed optic.

2. The machine in accordance with claim 1, wherein fluid is sprayed from each nozzle.

3. The machine in accordance with claim 2, wherein said optic when ground by said grinding wheel produces debris that is attracted to the sprayed fluid.

4. The machine in accordance with claim 1, wherein said transfer means is displaceable in a z-direction.

5. The machine in accordance with claim 1, wherein said transfer means comprises at least one gripper having at least two fingers displaceable between an open position and a closed position.

6. The machine in accordance with claim 5, wherein said transfer means comprises two grippers, each having at least two fingers.

7. The machine in accordance with claim 1, wherein said platform comprises a pair of vertical support members including an upper support member and a lower support member.

8. The machine in accordance with claim 7, wherein said platform further comprises a pair of pads disposed between said vertical support members for protecting said optic.

9. The machine in accordance with claim 7, wherein said upper support member is stationary and said lower support member is displaceable in a vertical direction.

10. The machine in accordance with claim 1, further comprising a memory device of a remote central processor for storing prescribed recipes for trimming said optic to different diameters.

11. A method for manufacturing an optic comprising the steps of:

(a) automatically downloading said optic off of a platform at an infeed station using a transfer means;

(b) moving said optic from the infeed station to an imaging station;

(c) determining a center of said optic while holding said optic in said transfer means;

(d) moving said optic from the imaging station to a grinding station;

(e) automatically loading said optic on to a platform at said grinding station using said transfer means;

(f) trimming excess resin from the edge of said optic using a grinding wheel based on a recipe selected from a plurality of prescribed recipes for different diameter optics stored in a memory device;

(g) automatically downloading said optic from said platform at said grinding station using said transfer means;

(h) moving said optic from the grinding station to the cleaning and drying station housed in a cleaning containment enclosure having a central axis;

(i) automatically loading said optic on to a platform at the cleaning and drying station using said transfer means;

(j) spraying both surfaces of said optic with a cleaning fluid;

(k) rotating said optic about the central axis of said cleaning containment enclosure to remove the cleaning fluid from the surfaces of said optic; and (l) automatically downloading said optic from said platform at the cleaning and drying station.

12. The method in accordance with claim 11, further comprising the step of moving said optic to said outfeed station.

13. The method in accordance with claim 11, wherein said determining step (c) comprises:

illuminating said optic using a light source to locate a substantially circular inner edge of said optic;

capturing an image of said illuminated optic; and determining the center of said optic based on the illuminated substantially circular inner edge of said optic.

14. The method in accordance with claim 11, wherein said platform at the grinding station includes an upper support member and a lower support member.

15. The method in accordance with claim 14, wherein said loading step (e) comprises:

lowering said lower support member in a vertical direction;

moving said transfer means so that said optic is positioned in contact with said upper support member; and raising said lower support member to simultaneously contact said optic and push against said transfer means so as to release said optic that remains held between said upper and lower support members.

16. The method in accordance with claim 11, wherein said grinding wheel and platform at the grinding station is disposed within a debris containment enclosure including a plurality of nozzles directed towards an inner wall of said debris containment enclosure.

17. The method in accordance with claim 16, further comprising the steps of spraying fluid from said nozzles against the inner wall of said debris containment enclosure, debris from said grinding of said optic being attracted to said sprayed fluid and expelled from said debris containment enclosure.

18. The method in accordance with claim 12, wherein said step of moving said optic to the outfeed station further comprises verifying that the diameter of said optic conforms with the selected prescribed recipe using said transfer means.

* * * * *